US010895266B2

(12) United States Patent
Pirouzpanah et al.

(10) Patent No.: US 10,895,266 B2
(45) Date of Patent: Jan. 19, 2021

(54) CENTRIFUGAL BLOWER ASSEMBLY AND METHOD FOR ASSEMBLING THE SAME

(71) Applicant: REGAL BELOIT AMERICA, INC., Beloit, WI (US)

(72) Inventors: Sahand Pirouzpanah, Miamisburg, OH (US); Joseph A. Henry, Dayton, OH (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 203 days.

(21) Appl. No.: 16/122,627

(22) Filed: Sep. 5, 2018

(65) Prior Publication Data

US 2019/0072109 A1 Mar. 7, 2019

Related U.S. Application Data

(60) Provisional application No. 62/555,309, filed on Sep. 7, 2017.

(51) Int. Cl.

| | |
|---|---|
| ***F04D 29/46*** | (2006.01) |
| ***F04D 29/42*** | (2006.01) |
| *F24F 7/06* | (2006.01) |

(52) U.S. Cl.

CPC ..... *F04D 29/4226* (2013.01); *F04D 29/462* (2013.01); *F04D 29/464* (2013.01); *F05D 2250/52* (2013.01); *F24F 7/065* (2013.01)

(58) Field of Classification Search

CPC .. F04D 29/4226; F04D 29/462; F04D 29/464; F05D 2250/52; F24F 7/065

See application file for complete search history.

(56) References Cited

U.S. PATENT DOCUMENTS

| | | | | | |
|---|---|---|---|---|---|
| 491,407 | A * | 2/1893 | Davis | F03B 3/00 | 415/151 |
| 2,649,242 | A * | 8/1953 | Payne | F24H 3/065 | 415/52.1 |
| 4,653,689 | A * | 3/1987 | Sakurai | B60H 1/00857 | 165/42 |
| 5,063,833 | A * | 11/1991 | Hara | B60H 1/345 | 454/152 |
| 5,470,276 | A * | 11/1995 | Burnell | B60H 1/345 | 454/155 |
| 5,697,841 | A * | 12/1997 | Di Giovine | F24F 13/065 | 454/290 |
| 6,131,336 | A * | 10/2000 | Krause | B60H 1/3414 | 49/74.1 |
| 6,789,617 | B1 * | 9/2004 | Hashizume | B60H 1/00857 | 165/103 |

(Continued)

*Primary Examiner* — Christopher Verdier
*Assistant Examiner* — Thoedore C Ribadeneyra
(74) *Attorney, Agent, or Firm* — Armstrong Teasdale LLP

(57) ABSTRACT

A centrifugal blower assembly comprises a scroll wall and a pair of opposing sidewalls. The scroll wall is positioned between the pair of opposing sidewalls such that the scroll wall and opposing sidewalls together define a blower chamber and a blower outlet. The blower outlet defines a blower outlet area. An adjustable outlet plate is pivotably coupled to the pair of opposing sidewalls such that the adjustable outlet plate is moveable between a first position to define a first blower outlet area and a second position to define a second blower outlet area.

20 Claims, 8 Drawing Sheets

(56) References Cited

U.S. PATENT DOCUMENTS 6,800,023 B2 * 10/2004 Demerath ..... F24F 13/15 454/155
7,416,481 B2 * 8/2008 Baker ..... F04D 25/14 361/679.48
7,997,964 B2 * 8/2011 Gehring ..... B60H 1/345 454/152
8,197,193 B2 * 6/2012 Messmer ..... F04D 27/003 415/126
8,602,723 B2 * 12/2013 Chou ..... F04D 29/422 415/126
8,657,558 B2 2/2014 June et al.
9,068,573 B2 * 6/2015 Kuo ..... F04D 25/0613
2005/0042078 A1 * 2/2005 Sturgell ..... F04D 29/4226 415/128
2009/0044835 A1 * 2/2009 Peters ..... F04D 25/02 134/25.1
2009/0274551 A1 * 11/2009 Messmer ..... F04D 29/4226 415/148
2011/0083832 A1 * 4/2011 Chou ..... F04D 29/626 165/121
2011/0243720 A1 * 10/2011 Post ..... F04D 29/4226 415/204
2011/0250049 A1 * 10/2011 June ..... F04D 29/422 415/1
2012/0298774 A1 * 11/2012 Vieira ..... A61L 9/122 239/302
2013/0129499 A1 * 5/2013 Michaud ..... F04D 29/626 415/213.1
2013/0142615 A1 * 6/2013 Hancock ..... F04D 29/4226 415/1
2013/0243585 A1 * 9/2013 Sinzaki ..... F04D 29/4206 415/204
2013/0323040 A1 * 12/2013 Fujita ..... F04D 25/0613 415/200
2016/0047389 A1 * 2/2016 Zhu ..... F04D 25/14 415/146
2016/0115965 A1 * 4/2016 Park ..... F04D 29/4226 415/212.1
2016/0143188 A1 * 5/2016 Kao ..... H01L 23/467 165/80.2
2016/0219653 A1 * 7/2016 Kim ..... H05B 6/6491
2016/0258438 A1 * 9/2016 Johnson ..... F04D 29/444
2017/0023024 A1 * 1/2017 Hsin ..... F04D 25/0613
2017/0080266 A1 3/2017 Krekoukis
2017/0097015 A1 * 4/2017 Song ..... F04D 29/30
2017/0130723 A1 * 5/2017 Kosaka ..... F04D 29/4213
2017/0191684 A1 7/2017 Tompkins
2017/0342992 A1 * 11/2017 Pirouzpanah ..... F04D 29/661
2018/0078890 A1 * 3/2018 Roston ..... F04D 29/706
2018/0209440 A1 * 7/2018 Kono ..... F04D 29/441

* cited by examiner

CENTRIFUGAL BLOWER ASSEMBLY AND METHOD FOR ASSEMBLING THE SAME

CROSS REFERENCE TO RELATED APPLICATIONS

This application claims the benefit of and priority to U.S. Provisional Patent Application Ser. No. 62/555,309, filed Sep. 7, 2017, which is incorporated herein by reference in its entirety.

BACKGROUND

The field of the disclosure relates generally to a housing for a centrifugal fan, and more specifically, to methods and apparatus for an adjustable centrifugal blower discharge.

Centrifugal fans or blowers are commonly used in the automotive, air handling and ventilation industries for directing large volumes of forced air, over a wide range of pressures, through a variety of air conditioning components. In a known centrifugal blower, air is drawn into a housing through one or more inlet openings by a rotating wheel. This air is then forced around the housing and out an outlet end. Known centrifugal blowers include a fixed discharge outlet that occupies a set volume which cannot be changed or made more compact. Certain applications of centrifugal blowers, such as HVAC applications, require a compact design to fit the centrifugal blower within tight spaces. Fixed discharge outlets on centrifugal blowers can occupy too much volume to allow the centrifugal blower to fit within the tight spaces. Additionally, fixed discharge outlets cannot adjust to change the trajectory of the outlet flow of air.

BRIEF DESCRIPTION

In one aspect, a centrifugal blower assembly is provided. The centrifugal blower assembly includes a scroll wall and a pair of opposing sidewalls. The scroll wall is positioned between the pair of opposing sidewalls such that the scroll wall and opposing sidewalls together define a blower chamber and a blower outlet. The blower outlet defines a blower outlet area. An adjustable outlet plate is pivotably coupled to the pair of opposing sidewalls such that the adjustable outlet plate is moveable between a first position to define a first blower outlet area and a second position to define a second blower outlet area.

In another aspect, a centrifugal blower assembly is provided. The centrifugal blower assembly includes a scroll wall and a pair of opposing sidewalls. The scroll wall is positioned between the pair of opposing sidewalls such that the scroll wall and opposing sidewalls together define a blower chamber and a blower outlet. The blower outlet defines a blower outlet area. An adjustable outlet plate is pivotably coupled to the pair of opposing sidewalls. During a first operational mode, the adjustable outlet plate is pivotably positioned with the blower outlet such that the blower outlet area has a first area. During a second operational mode, the adjustable outlet plate is pivotably positioned with the blower outlet such that the blower outlet area has a second area greater than the first area.

In yet another aspect, a method of assembling a centrifugal blower assembly is provided. The method comprises positioning a scroll wall between a pair of opposing side walls to define a blower chamber and a blower outlet. An adjustable outlet plate is pivotably positioned within the blower outlet and between the pair of opposing side walls such that the adjustable outlet plate is moveable between a first position to define a first blower outlet area and a second position to define a second blower outlet area.

DETAILED DESCRIPTION

Figure 1:
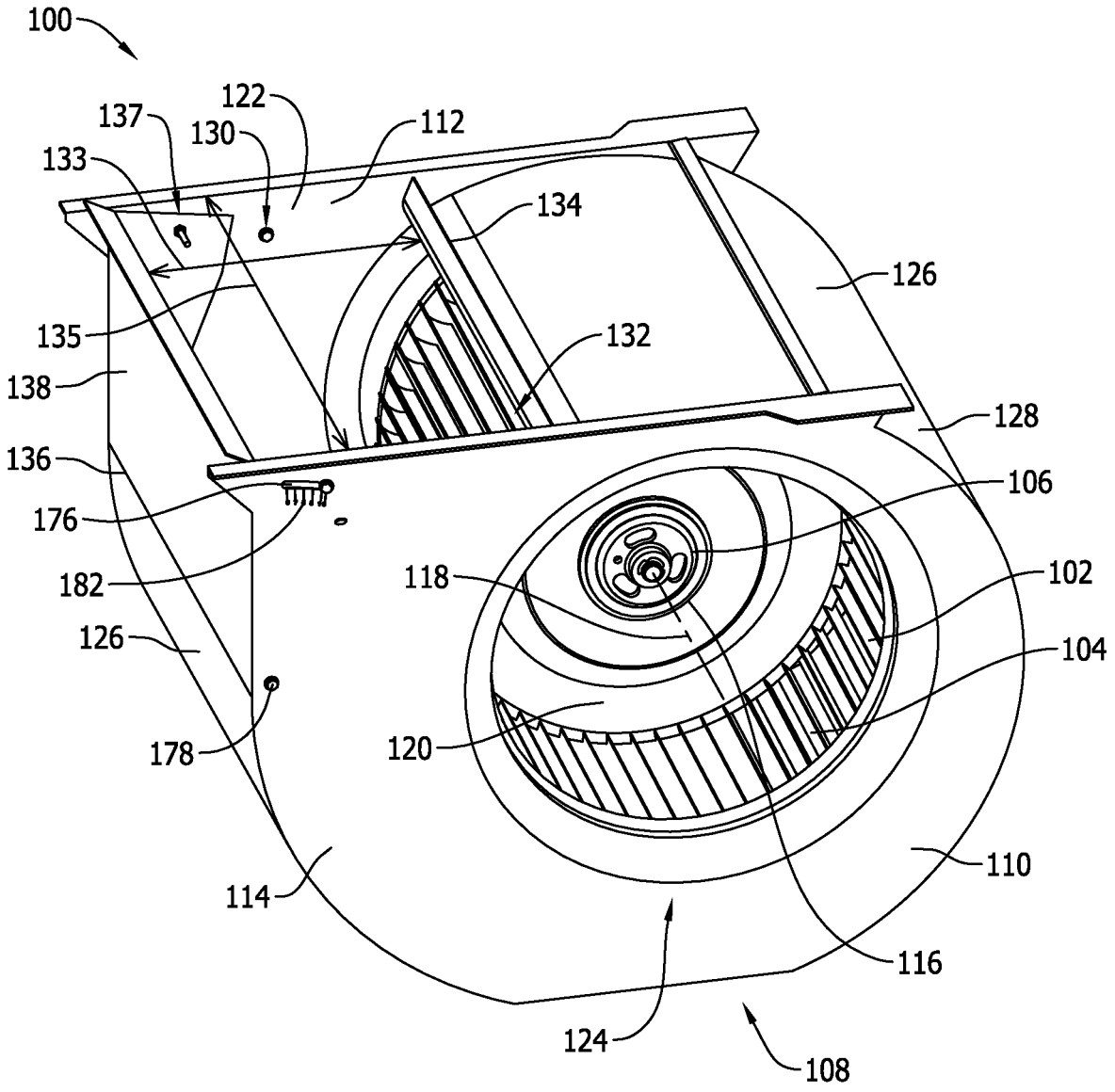
FIG. 1 is a perspective view of an exemplary blower assembly.

The embodiments described herein relate to a centrifugal fan housing. More specifically, embodiments relate to a centrifugal fan housing that includes an adjustable discharge opening. FIG. 1 illustrates an exemplary embodiment of a centrifugal blower assembly 100. Blower assembly 100 includes at least one wheel 102 that includes a plurality of fan blades 104 positioned circumferentially about wheel 102. Wheel 102 is further coupled to a wheel hub 106. Blower 100 further includes a housing 108 comprising a rear portion 110 and a front portion 112. Rear portion 110 includes a sidewall 114 through which a motor 116 is inserted. Motor 116 includes a shaft 118 that engages hub 106 to facilitate rotation of wheel 102 about an axis 120. Front portion 112 of housing 108 also includes a sidewall 122. Sidewalls 114 and 122 include an inlet 124 through which a volume of air is drawn by wheel 102 to provide air to blower assembly 100. Moreover, blower 100 includes a scroll wall 126 defining a blower circumference 128 and is positioned between sidewall 114 and sidewall 122. Scroll wall 126 extends circumferentially from a cut-off point 134 about a blower chamber 130 to a scroll wall end point 136 and covers a portion of blower circumference 128.

In the exemplary embodiment, an adjustable outlet plate 138 extends from scroll wall end point 136. As such, adjustable outlet plate 138, sidewall 114, and sidewall 122 together define blower chamber 130 and an outlet 132 through which an air stream is exhausted downstream of blower assembly 100. As shown in FIG. 1, outlet 132 includes an adjustable height 133 and a width 135 which define an adjustable outlet area 137. Although blower assembly 100 is illustrated as having only one inlet, outlet, and wheel, blower assembly 100 may include any number of inlets, outlets, and wheels.

Scroll wall 126 is positioned progressively further from wheel 102 in the direction of rotation to accommodate the growing volume of air due to the scroll shape of chamber 130. Rotation of wheel 102 facilitates drawing air through inlet 124, passing it around blower chamber 130, and exhausting it through outlet 132. In the exemplary embodiment, blower assembly 100 includes a single wheel 102 and inlet 124, alternatively, blower assembly 100 may include more than one wheel and/or inlet.

Figure 2:
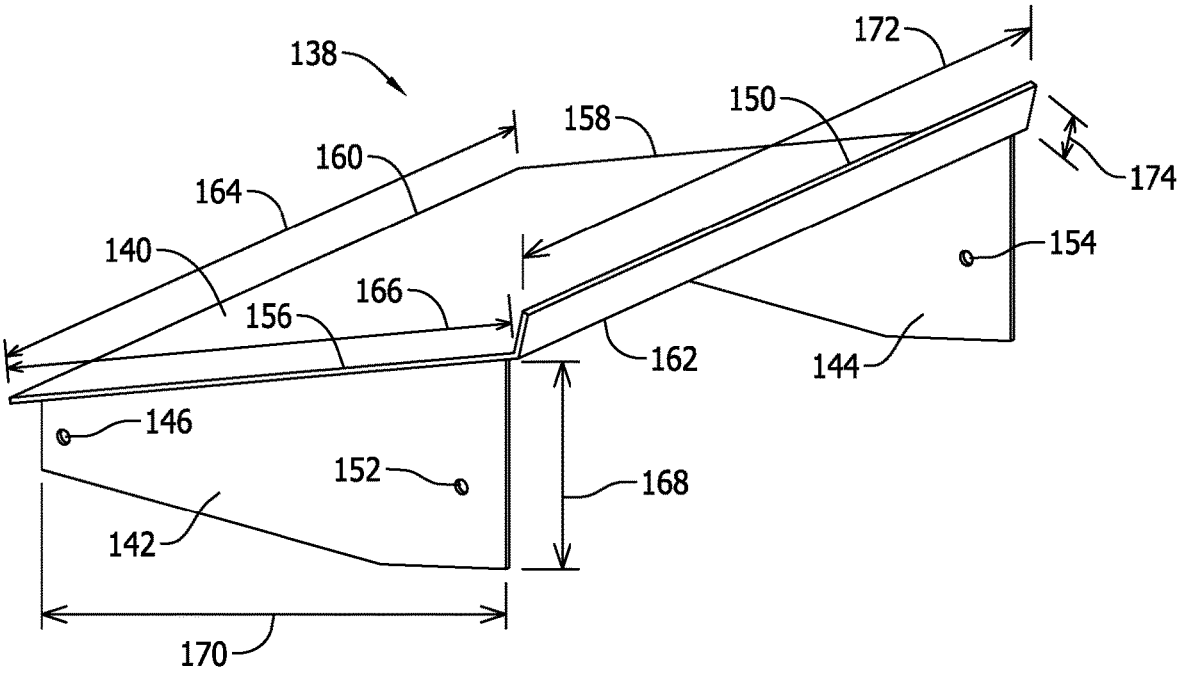
FIG. 2 is a perspective view of an adjustable outlet plate.
Figure 3:
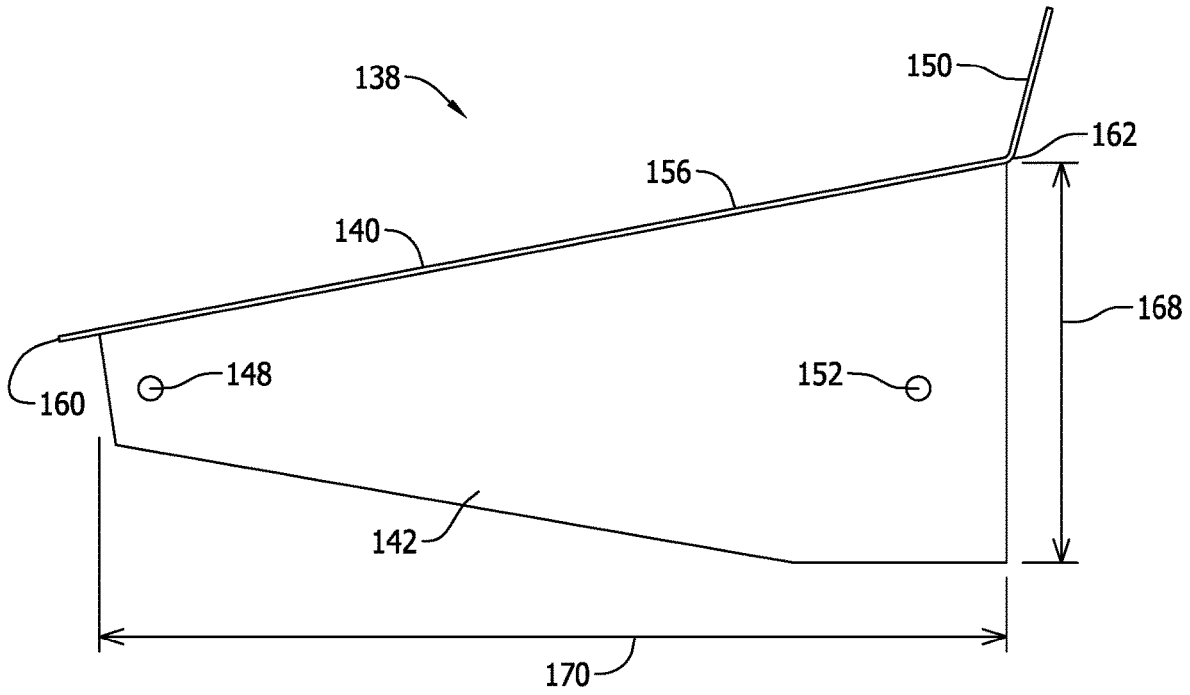
FIG. 3 is a side view of the adjustable outlet plate shown in FIG. 2.

FIG. 2 illustrates an exemplary embodiment of adjustable outlet plate 138. FIG. 3 is a side view of adjustable outlet plate 138 shown in FIG. 2. Adjustable outlet plate 138 includes a scroll wall plate 140, two sidewall plates 142 and 144, two pivot holes 146 and 148, an outlet lip 150, and two fastener holes 152 and 154. Scroll wall plate 140 includes two side edges 156 and 158, a back edge 160, and a front edge 162. Scroll wall plate 140 also includes a width 164 and a height 166. Sidewall plate 142 extends from side edge 156 and sidewall plate 144 extends from side edge 158. Both sidewall plates 142 and 144 extend from scroll wall plate 140 in a direction perpendicular to scroll wall plate 140 and substantially toward axis 120. Both sidewall plates 142 and 144 include a length 168 and a height 170. Pivot hole 146 and fastener hole 152 extend through sidewall plates 142 and pivot hole 148 and fastener hole 154 extend through sidewall plates 144. Outlet lip 150 extends from front edge 162 and includes a width 172 and a length 174. Outlet lip 150 configured to seal outlet 132 to an appliance to prevent leakage between blower assembly 100 and the appliance.

In the exemplary embodiment, when adjustable outlet plate 138 is in a first position (as shown in FIG. 1), outlet 132 has adjustable height 133 of approximately 7.4 inches to approximately 8.3 inches and width 135 of approximately 6.8 inches to approximately 14.4 inches. Adjustable height 133 and width 134 define first blower outlet area 137 when adjustable outlet plate 138 is in the first position. Alternatively, outlet 132 may have any adjustable height 133 and width 135 that enables blower assembly 100 to function as described herein.

In the exemplary embodiment, scroll wall plate 140 has height 166 of approximately 7.5 inches and width 164 of approximately 6.8 inches to approximately 14.3 inches. Alternatively, scroll wall plate 140 may have any height 166 and width 164 that enables blower assembly 100 to function as described herein. Scroll wall plate 140 width 164 is less than outlet 132 width 135 such that adjustable outlet plate 138 pivotably extends between sidewalls 114 and 122.

In the exemplary embodiment, sidewall plates 142 and 144 each have length 168 of approximately 3 inches and height 170 of approximately 6.7 inches. Alternatively, sidewall plates 142 and 144 may have any length 168 and height 170 that enables blower assembly 100 to function as described herein. In the exemplary embodiment, sidewall plates 142 and 144 height 170 is equal to scroll wall plate 140 height 166.

In the exemplary embodiment, outlet lip 150 has length 174 of approximately 0.85 inches and width 172 of approximately 6.8 inches to approximately 14.3 inches. Alternatively, outlet lip 150 may have any length 174 and width 172 that enables blower assembly 100 to function as described herein. In the exemplary embodiment, outlet lip 150 width 172 is equal to scroll wall plate 140 width 164.

Figure 4:
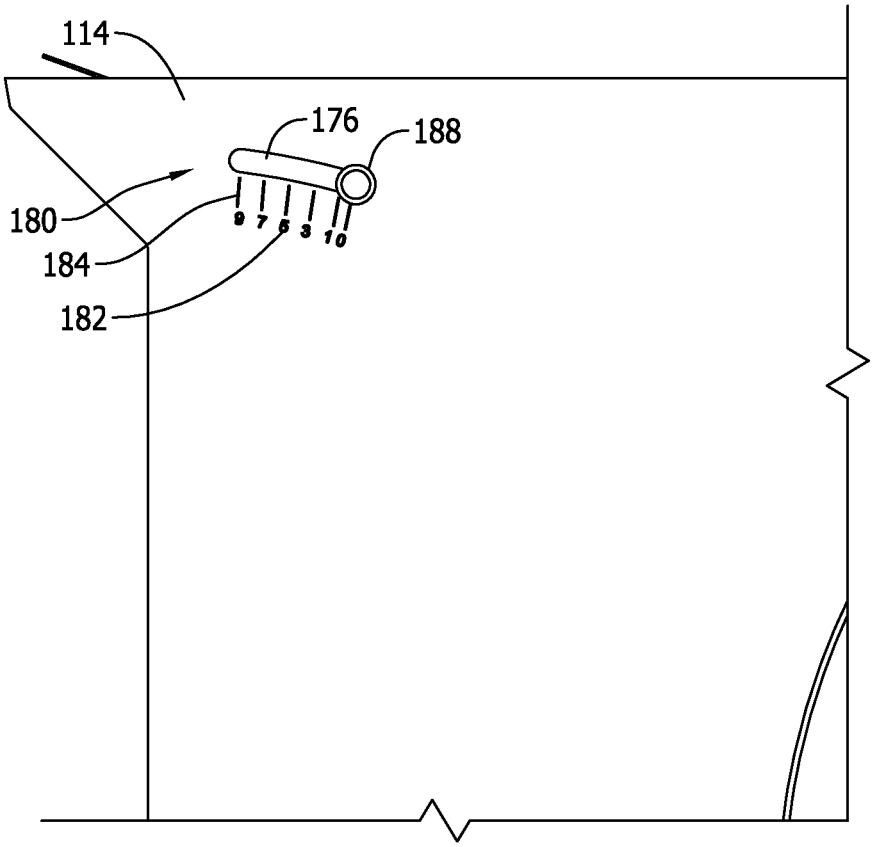
FIG. 4 is a side view of the blower assembly shown in FIG. 1.
Figure 5:
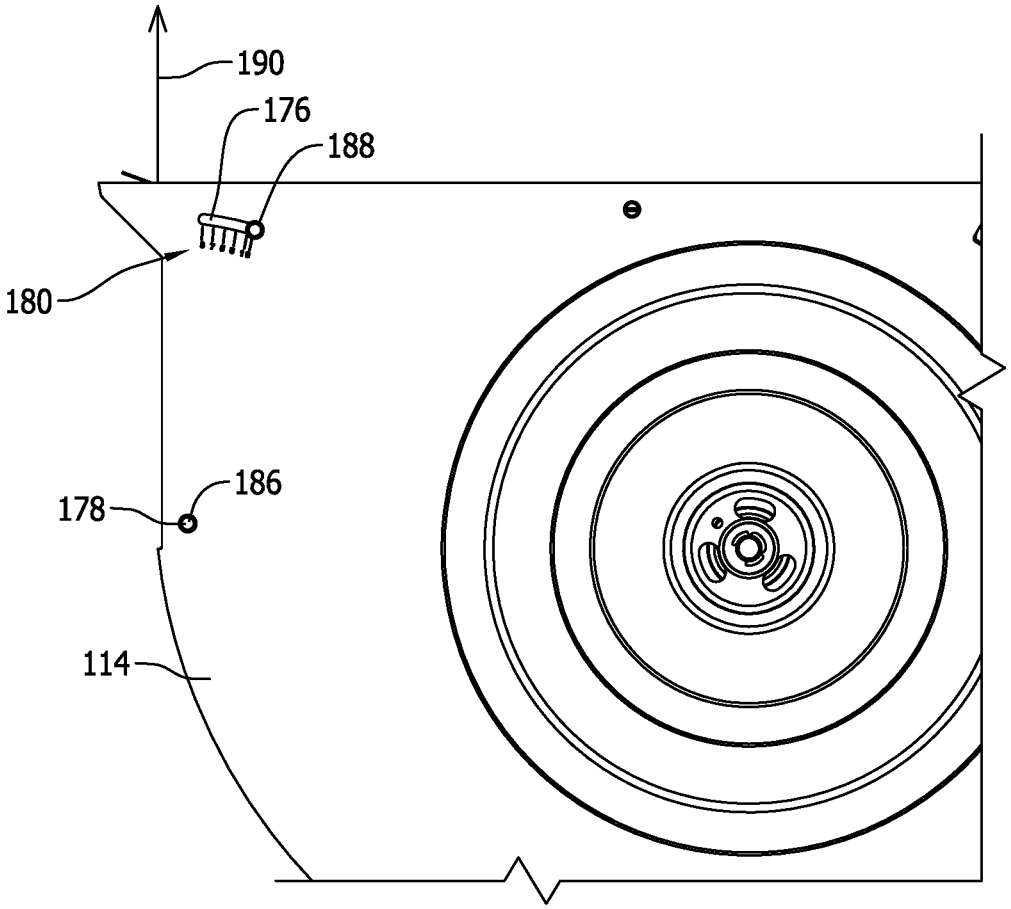
FIG. 5 is a side view of the blower assembly shown in FIG. 1 in a compact configuration.
Figure 6:
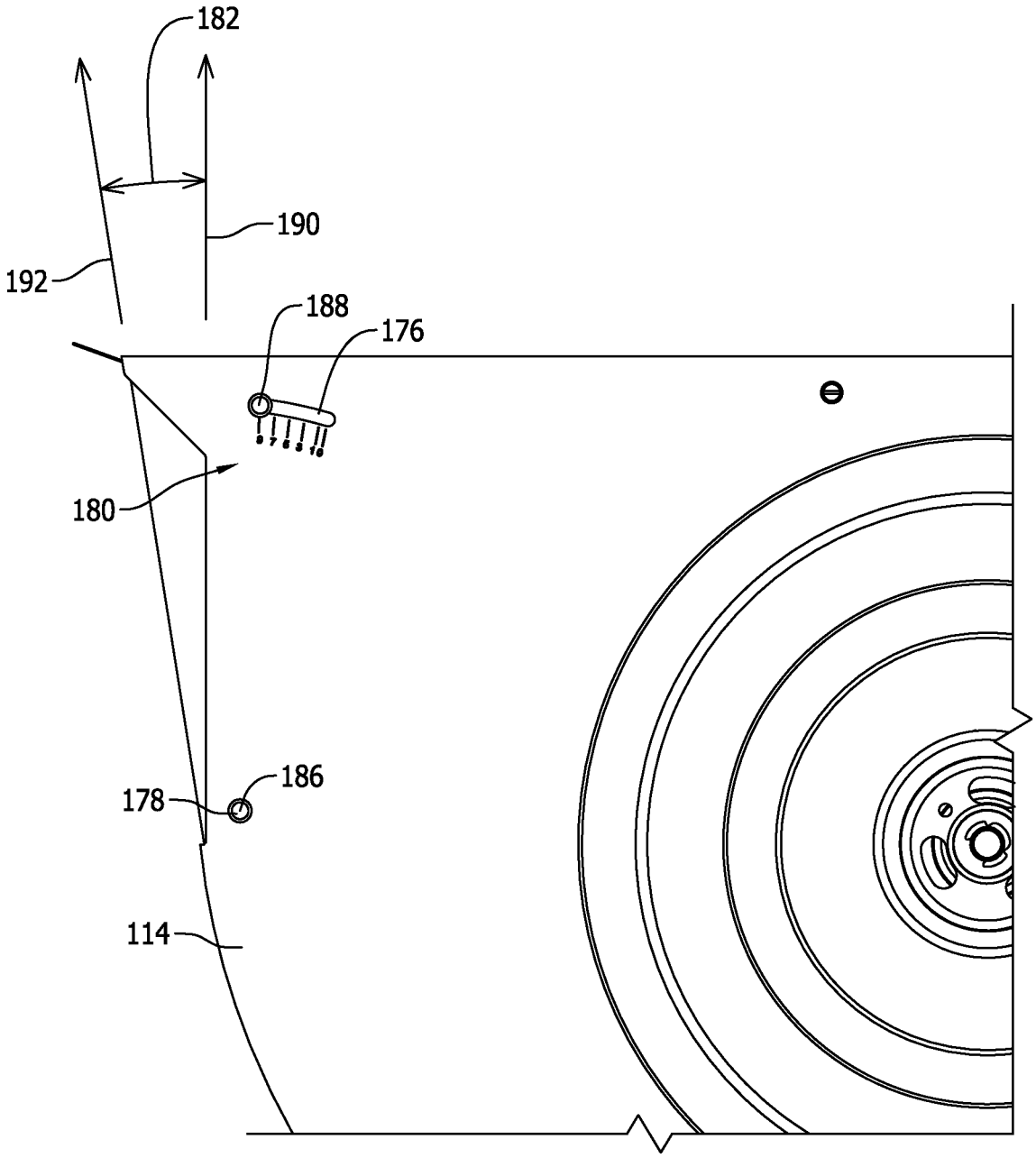
FIG. 6 is a side view of the blower assembly shown in FIG. 1 in an open configuration.
Figure 7:
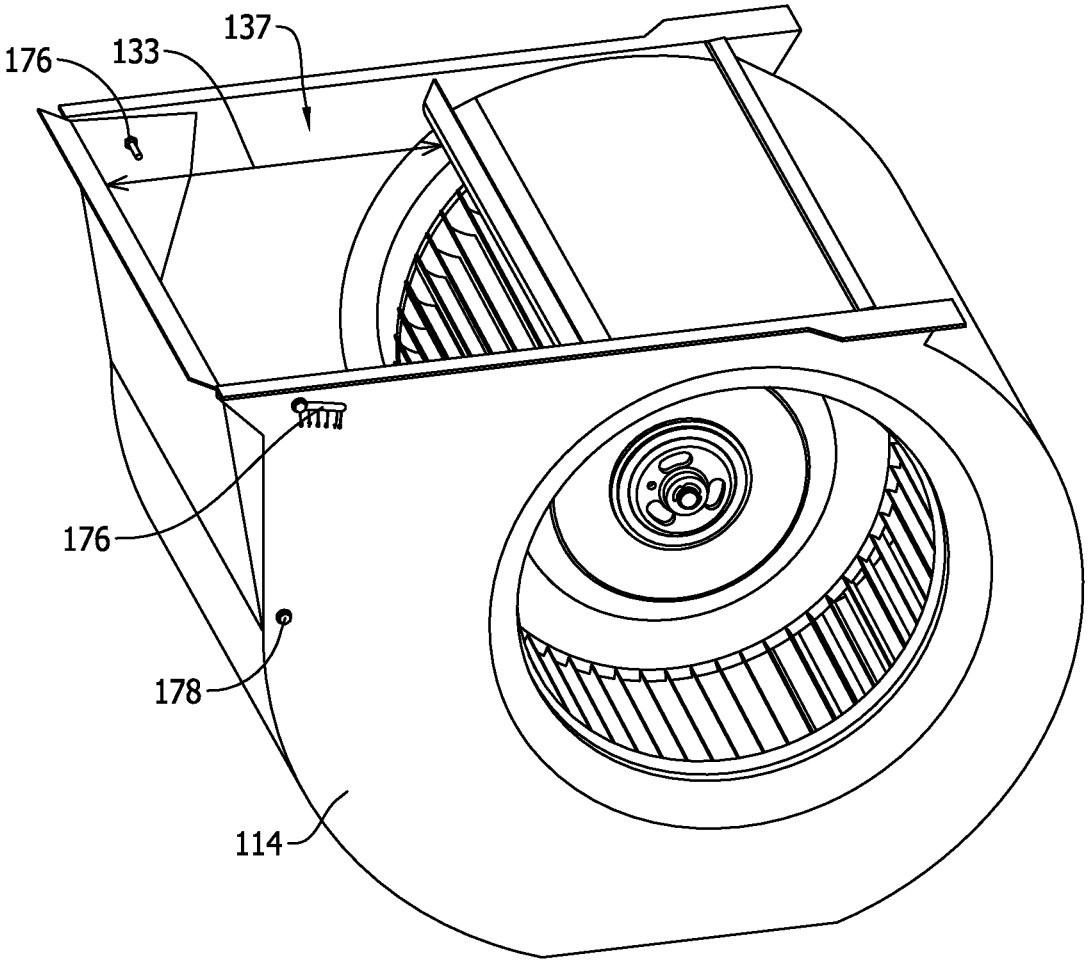
FIG. 7 is a perspective view of the blower assembly shown in FIG. 1 in an open configuration.

FIG. 4 is a side view of blower assembly 100 shown in FIG. 1. FIG. 5 is a side view of blower assembly 100 shown in FIG. 1 in a compact configuration with adjustable outlet plate 138 in a second position. FIG. 6 is a side view of blower assembly 100 shown in FIG. 1 in an open configuration with adjustable outlet plate 138 in the first position. FIG. 7 is a perspective view of blower assembly 100 shown in FIG. 1 in an open configuration with adjustable outlet plate 138 in the first position. Sidewalls 114 and 122 each include a scale slot 176 and a pivot hole 178 extending therethrough. Additionally, sidewalls 114 and 122 each include a plurality of scale markings 180 adjacent scale slot 176 which indicate an angle 182 of opening of outlet 132. In the exemplary embodiment, scale markings 180 include a numerical indicator 181 and a line 184. Numerical indicator 181 indicates the numeric value in degrees of angle 182 of opening of outlet 132. Line 184 indicates the location within scale slot 176 that corresponds to numerical indicator 181.

Two pivot fasteners 186 extend through pivot holes 178 of sidewalls 114 and 122 and pivot holes 146 and 148 of sidewall plates 142 and 144. Pivot fasteners 186 are configured to maintain the position of adjustable outlet plate 138 between sidewalls 114 and 122 while allowing adjustable outlet plate 138 to pivot around pivot fasteners 186. In the exemplary embodiment, pivot fasteners 186 include bolts. Alternatively, pivot fasteners 186 may include any fastener that enables blower assembly 100 to function as described herein.

Two adjustable fasteners 188 extend through scale slots 176 of sidewalls 114 and 122 and fastener holes 152 and 154 of sidewall plates 142 and 144. Adjustable fasteners 188 are configured to maintain the position of adjustable outlet plate 138 between sidewalls 114 and 122 after an angle 182 of opening of outlet 132 has been selected. In the exemplary embodiment, adjustable fasteners 188 include bolts. Alternatively, adjustable fasteners 188 may include any fastener that enables blower assembly 100 to function as described herein.

During operations of blower assembly 100, adjustable fasteners 188 are loosened to allow adjustable outlet plate 138 to pivot about pivot fasteners 186. Adjustable outlet plate 138 is pivoted about pivot fasteners 186 until angle 182 of opening of outlet 132 is a predetermined angle. In the exemplary embodiment, adjustable outlet plate 138 is pivoted about pivot fasteners 186 by sliding adjustable fasteners 188 through scale slots 176 until angle 182 of opening of outlet 132 is the predetermined angle. Alternatively, adjustable outlet plate 138 may be pivoted about pivot fasteners 186 by any method which enables blower assembly 100 to function as described herein. Adjustable fasteners 188 are tightened to secure adjustable outlet plate 138 between sidewalls 114 and 122 and to maintain angle 182 of opening of outlet 132 at the predetermined angle during operation of blower assembly 100.

In the exemplary embodiment, angle 182 of opening of outlet 132 ranges from approximately 0 degrees to approximately 9 degrees. Alternatively, angle 182 of opening of outlet 132 may be any angle that enables blower assembly 100 to function as described herein. In the exemplary embodiment, numerical indicators 182 range from approximately 0 degrees to approximately 9 degrees. Alternatively, numerical indicators 182 may range between any angle that enables blower assembly 100 to function as described herein.

Increasing angle 182 of opening of outlet 132 increases adjustable height 133 of outlet 132 and also enlarges outlet area 137 as shown in FIG. 7. In the exemplary embodiment, increasing angle 182 of opening of outlet 132 from approximately 0 degrees to approximately 9 degrees increases adjustable height 133 from approximately 7.4 inches to approximately 9.4 inches and enlarges outlet area 137 by approximately 13% to approximately 15% as compared to the outlet area 137 in the first position as shown in FIG. 7. As such, when adjustable outlet plate 138 is in the second position, blower inlet area 137 defines a second area.

The adjustability of adjustable outlet plate 138 allows blower assembly 100 to change from a compact configuration to an open configuration. Blower assembly 100 is in a compact configuration when angle 182 of opening of outlet 132 is set to 0 degrees as shown in FIGS. 1, 4, and 5. Alternatively, blower assembly 100 is in an open configuration when angle 182 of opening of outlet 132 is set to 9 degrees as shown in FIGS. 6 and 7. Blower assembly 100 occupies less volume when in the compact configuration as compared to the open configuration because adjustable outlet plate 138 does not extend from housing 108 in the compact configuration. As such, pivoting adjustable outlet plate 138 allows blower assembly 100 to become more compact and to fit into tight spaces and tight HVAC appliances. In application with smaller discharge duct sizes, additional efficiency gains are obtained using the compact blower.

Adjusting angle 182 of opening of outlet 132 also allows the discharge air to be directed in different directions. The open configuration directs a portion of discharge air in direction 192 as shown in FIG. 6. The compact configuration directs discharge air in direction 190 as shown in FIG. 5. Direction 192 is at an angle relative to direction 190 and, as such, the flow of discharge air from the open configuration is more spread out than the flow of discharge air from the compact configuration.

Additionally, as previously discussed, adjusting angle 182 of opening of outlet 132 also increases outlet area 137, which adjusts the outlet velocity of discharge air from blower assembly 100. The compact configuration, which has the smallest outlet area 137, has the highest outlet velocity of discharge air from blower assembly 100. Alternatively, the open configuration, which has the largest outlet area 137, has the slowest outlet velocity of discharge air from blower assembly 100. Adjusting the outlet velocity of discharge air tunes the heat transfer and pressure drops in downstream equipment. As such, adjusting angle 182 of opening of outlet 132 tunes the outlet velocity of discharge air from blower assembly 100, which tunes the heat transfer rates and pressure drop in downstream heat exchanging equipment, such as HVAC equipment. To avoid sudden expansion and its corresponding pressure losses, blower assembly 100 provides the flexibility to tune outlet area 137 to different discharge duct sizes while maintaining the optimal performance of blower assembly 100.

Adjustable outlet plate 138 is pivotably coupled to the pair of sidewalls 114 and 122. Adjustable outlet plate 138 is moveable between a first position or compact configuration (when angle 182 of opening of outlet 132 is set to 0 degrees as shown in FIGS. 1, 4, and 5) to define a first blower outlet area 137 (the smallest outlet area 137) and a second position or open configuration (when angle 182 of opening of outlet 132 is set to 9 degrees as shown in FIGS. 6 and 7) to define a second blower outlet area (the largest outlet area 137). During a first operational mode, adjustable outlet plate 138 is pivotably positioned with blower outlet 132 such that blower outlet area 137 has a first area. During a second operational mode, adjustable outlet plate 138 is pivotably positioned with blower outlet 132 such that the blower outlet area 137 has a second area greater than the first area. In the exemplary embodiment, during the first operational mode, adjustable outlet plate 138 is pivotably positioned with blower outlet 132 such that angle 182 of opening of outlet 132 is set to 0 degrees (as shown in FIGS. 1, 4, and 5) to define a first blower outlet area 137 (the smallest outlet area 137). Additionally, during the second operational mode, adjustable outlet plate 138 is pivotably positioned with blower outlet 132 such that angle 182 of opening of outlet 132 is set to 9 degrees (as shown in FIGS. 6 and 7) to define a second blower outlet area (the largest outlet area 137). Second blower outlet area 137 is greater than first blower outlet area 137.

Figure 8:
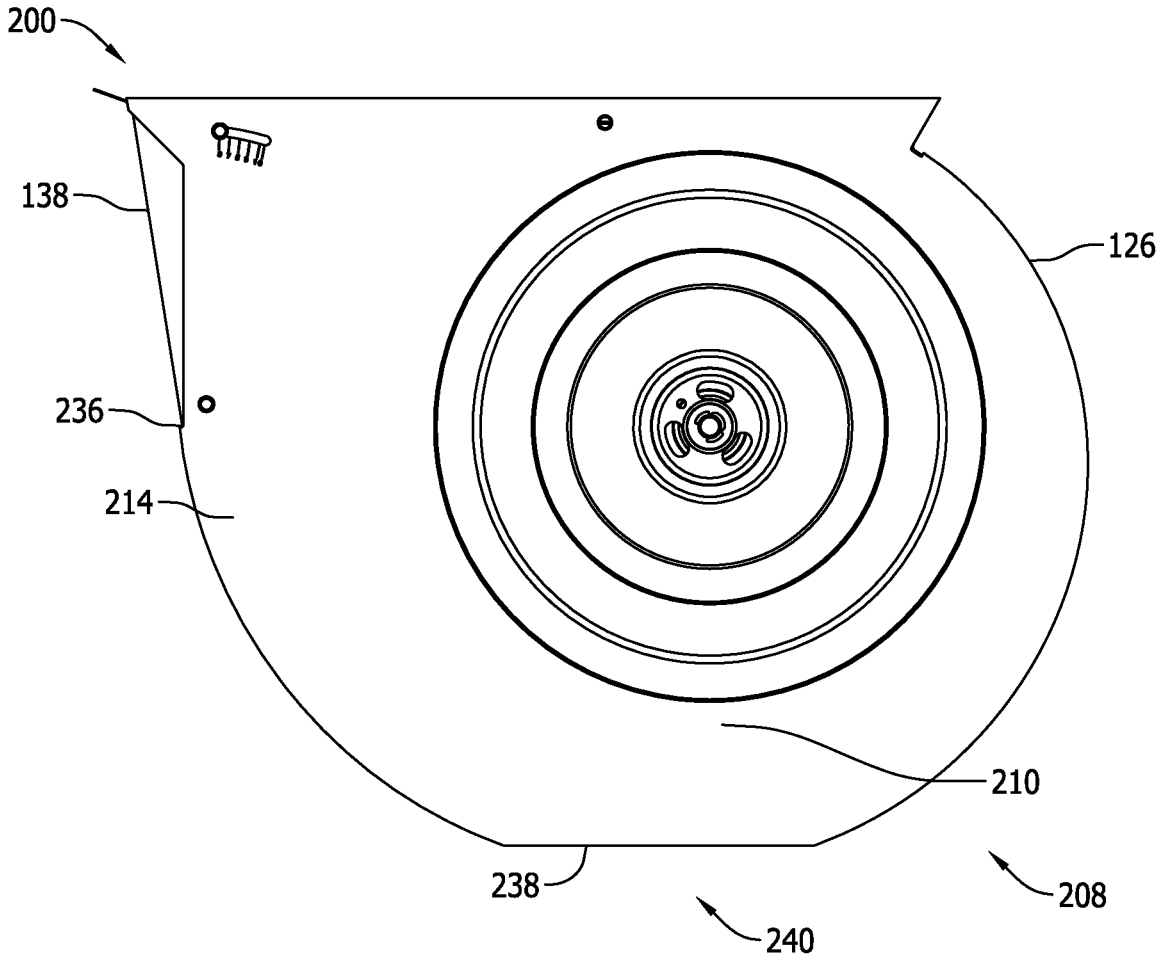
FIG. 8 is a side view of an alternative embodiment of the blower assembly shown in FIG. 1.

FIG. 8 illustrates an alternative embodiment of blower assembly 100. Like components will be given like reference numerals for ease of understanding. FIG. 8 is a side view of a blower assembly 200. Blower assembly 200 includes a housing 208 comprising a rear portion 210 and a front portion 212. Rear portion 210 includes a sidewall 214 and front portion 212 (not shown in FIG. 8) of housing 208 also includes a sidewall 222 (not shown in FIG. 8). Moreover, blower assembly 200 includes a scroll wall 226 defining a blower circumference 228 and is positioned between sidewall 214 and sidewall 222. Scroll wall 226 extends circumferentially from a cut-off point 234 (not shown in FIG. 8) about housing chamber 230 (not shown in FIG. 8) to a scroll wall end point 236. Adjustable outlet plate 138 extends from scroll wall end point 236. Scroll wall 226 and sidewalls 214 and 222 all include corresponding flattened portions 238 which form a flattened portion 240 of blower circumference 228. Blower assembly 200 is a more compact design than blower assembly 100 because flattened portion 240 does not extend blower circumference 228 out as far as blower circumference 128. As such, blower assembly 200 is able to fit within tighter spaces than blower assembly 100.

The exemplary embodiments of a centrifugal blower assembly described herein are more compact in order to fit into tighter spaces. Generally, optimization of the shape and placement of the centrifugal blower assembly depends on many factors, such as the size of the blower housing and the volume of the space the centrifugal blower assembly is to occupy. Specifically, adjusting the shape and size of the centrifugal blower assembly outlet such that the overall volume of the blower housing is smaller allows the centrifugal blower assembly to fit into smaller volumes. To this end, the centrifugal blower assembly includes an adjustable outlet plate that reduces the volume of the centrifugal blower assembly discharge and the volume of the blower housing. Furthermore, adjusting the centrifugal blower assembly discharge allows the discharge air to be directed in different directions and the heat transfer properties of the discharge air to be tuned for downstream heat transfer equipment.

Exemplary embodiments of a centrifugal blower assembly and a method for assembling the same are described above in detail. The methods and assembly are not limited to the specific embodiments described herein, but rather, components of the assembly and/or steps of the methods may be utilized independently and separately from other components and/or steps described herein. For example, the methods may also be used in combination with other air stream distribution systems and methods, and are not limited to practice with only the assembly and methods as described herein. Rather, the exemplary embodiment can be implemented and utilized in connection with many other air stream distribution applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A centrifugal blower assembly comprising:

a scroll wall and a pair of opposing sidewalls, said scroll wall positioned between said pair of opposing sidewalls such that said scroll wall and said pair of opposing sidewalls define a blower chamber, said scroll wall comprises a cut-off point, said pair of opposing sidewalls each comprise an outlet end; and an adjustable outlet plate pivotably coupled to said pair of opposing sidewalls, said adjustable outlet plate comprises a front edge, said cut-off point, said outlet ends of said pair of opposing sidewalls, and said front edge define a blower outlet, said blower outlet defining a blower outlet area, said adjustable outlet plate comprises an outlet lip extending from said front edge of said scroll wall plate, wherein said adjustable outlet plate is moveable between a first position to define a first blower outlet area and a second position to define a second blower outlet area.

2. The centrifugal blower assembly in accordance with claim 1, wherein said adjustable outlet plate is configured to pivot about at least one pivot fastener.

3. The centrifugal blower assembly in accordance with claim 2, wherein each sidewall of said pair of opposing sidewalls define a scale slot extending therethrough.

4. The centrifugal blower assembly in accordance with claim 3, wherein said adjustable outlet plate includes a scroll wall plate and two sidewall plates extending from said scroll wall plate, said two sidewall plates each define a fastener hole extending therethrough.

5. The centrifugal blower assembly in accordance with claim 4 further comprising a pair of adjustable fasteners extending through said scale slots and said fastener holes, wherein said adjustable fasteners are configured to maintain a position of said adjustable outlet plate between said pair of opposing sidewalls.

6. The centrifugal blower assembly in accordance with claim 5, said two sidewall plates each define a pivot hole extending therethrough, said pair of opposing sidewalls define a pair of sidewall pivot holes extending therethrough, wherein said at least one pivot fastener extends through said pivot holes and said sidewall pivot holes.

7. The centrifugal blower assembly in accordance with claim 6 wherein each sidewall of said opposing sidewalls includes a plurality of scale markings adjacent said scale slot.

8. The centrifugal blower assembly in accordance with claim 7, wherein said scroll wall plate comprises two side edges, said two sidewall plates extend from said two side edges of said scroll wall plate.

9. The centrifugal blower assembly in accordance with claim 4, wherein said outlet lip extends from said scroll wall plate such that said outlet lip and said blower outlet define an obtuse angle therebetween.

10. A centrifugal blower assembly comprising:

a scroll wall and a pair of opposing sidewalls, said scroll wall positioned between said pair of opposing sidewalls such that said scroll wall and said pair of opposing sidewalls define a blower chamber, said scroll wall comprises a cut-off point, said pair of opposing sidewalls each comprise an outlet end; and an adjustable outlet plate pivotably coupled to said pair of opposing sidewalls, said adjustable outlet plate comprises a front edge, said cut-off point, said outlet ends of said pair of opposing sidewalls, and said front edge define a blower outlet, said blower outlet defining a blower outlet area, said adjustable outlet plate comprises an outlet lip extending from said front edge of said scroll wall plate, wherein during a first operational mode said adjustable outlet plate is pivotably positioned with said blower outlet such that the blower outlet area has a first area, wherein during a second operational mode said adjustable outlet plate is pivotably positioned with said blower outlet such that the blower outlet area has a second area greater than the first area.

11. The centrifugal blower assembly in accordance with claim 10, wherein said adjustable outlet plate is in a first position in said first operational mode, and wherein said adjustable outlet plate is in a second position in said second operational mode.

12. The centrifugal blower assembly in accordance with claim 10, wherein said adjustable outlet plate is configured to pivot about at least one pivot fastener to adjust a volume of said blower chamber.

13. The centrifugal blower assembly in accordance with claim 10, wherein said adjustable outlet plate is configured to pivot about at least one pivot fastener to adjust a discharge angle of a flow of discharge air from said centrifugal blower assembly.

14. The centrifugal blower assembly in accordance with claim 10, wherein said adjustable outlet plate is configured to pivot about at least one pivot fastener to adjust a discharge velocity of a flow of discharge air from said centrifugal blower assembly.

15. The centrifugal blower assembly in accordance with claim 10, wherein said adjustable outlet plate is configured to pivot about at least one pivot fastener to adjust at least one heat transfer property of a flow of discharge air from said centrifugal blower assembly.

16. A method of assembling a centrifugal blower assembly, said method comprising:

coupling a scroll wall between a pair of opposing side walls to define a blower chamber, the scroll wall includes a cut-off point, the pair of opposing sidewalls each include an outlet end;

pivotally coupling an adjustable outlet plate between the pair of opposing side walls, the adjustable outlet plate includes a front edge, the cut-off point, the outlet ends of the pair of opposing sidewalls, and the front edge define a blower outlet, the blower outlet defining a blower outlet area, the adjustable outlet plate includes an outlet lip extending from said front edge of said scroll wall plate, the adjustable outlet plate is moveable between a first position to define a first blower outlet area and a second position to define a second blower outlet area.

17. The method in accordance with claim 16, wherein pivotally coupling the adjustable plate comprises:

pivotally coupling a pair of sidewall plates to the pair of opposing sidewalls, wherein the two sidewall plates each define a fastener hole extending therethrough;

coupling a scroll plate between the pair of sidewall plates; and inserting a pivot fastener through each fastener hole such that the adjustable outlet plate is configured to pivot about the at least one pivot fastener.

18. The method in accordance with claim 16, further comprising:

forming a scale slot on each wall of the pair of opposing sidewalls;

forming a fastener hole through each wall of the pair of opposing sidewalls; and inserting an adjustable fastener through each scale slot and each fastener hole such that the adjustable fasteners maintain a position of the adjustable outlet plate between the pair of opposing sidewalls.

19. The method in accordance with claim 18, further comprising forming a plurality of scale markings on each wall of the pair of opposing sidewalls adjacent the scale slot.

20. The method in accordance with claim 16, further comprising sealing the blower outlet to an appliance using the outlet lip.

* * * * *